US005669281A

United States Patent [19]

Comarmond

[11] Patent Number: 5,669,281

[45] Date of Patent: Sep. 23, 1997

[54] METHOD AND MACHINE FOR ALTERING THE STRIKING STROKE OF A PERCUSSIVE MACHINE MOVED BY A PRESSURIZED INCOMPRESSIBLE FLUID

[75] Inventor: Jean S. Comarmond, Vourles, France

[73] Assignee: Etablissements Montabert, Saint Priest, France

[21] Appl. No.: 565,577

[22] Filed: Nov. 30, 1995

[30] Foreign Application Priority Data

Dec. 8, 1994 [FR] France ..... 94 15020

[51] Int. Cl.[6] ..... F01L 1/20; F01L 31/00

[52] U.S. Cl. ..... 91/245; 91/277; 91/278

[58] Field of Search ..... 91/245, 264, 274, 91/277, 278, 279, 280; 92/13; 60/413

[56] References Cited

U.S. PATENT DOCUMENTS

| | | | |
|---|---|---|---|
| 3,552,269 | 1/1971 | Arnot | 91/278 |
| 3,720,137 | 3/1973 | Landherr et al. | 91/279 |
| 4,016,941 | 4/1977 | Sanders | 91/277 X |
| 4,858,702 | 8/1989 | Piras . | |
| 4,951,757 | 8/1990 | Hamada et al. | 91/277 X |

FOREIGN PATENT DOCUMENTS

| | | |
|---|---|---|
| 0080446 | 6/1983 | European Pat. Off. . |
| 0214064 | 3/1987 | European Pat. Off. . |
| 0256955 | 2/1988 | European Pat. Off. . |
| 0300929 | 1/1989 | European Pat. Off. . |
| 4019016 | 6/1991 | Germany . |

*Primary Examiner*—Hoang Nguyen
*Attorney, Agent, or Firm*—Oliff & Berridge

[57] ABSTRACT

Method and apparatus for controlling a percussive machine by determining, during the phase of rebound of a piston following impact, the existence of an instantaneous flow rate of fluid flowing from a top chamber toward the high-pressure fluid feed circuit. The instantaneous flow rate is determined on the basis of the differential pressure between the top chamber and the high pressure fluid feed circuit. If a flow rate is detected, a control device is fed with pressurized fluid so as to shift a selector piston in a direction for lengthening the stroke of the striking piston.

13 Claims, 6 Drawing Sheets

METHOD AND MACHINE FOR ALTERING THE STRIKING STROKE OF A PERCUSSIVE MACHINE MOVED BY A PRESSURIZED INCOMPRESSIBLE FLUID

The subject of the present invention is a method for automatically altering the stroke of the striking piston of a percussive machine moved by a pressurized incompressible fluid, and to a machine for the implementation of this method.

BACKGROUND OF THE INVENTION

Percussive machines moved by a pressurized incompressible fluid are fed with fluid such that the resultant of the hydraulic forces applied to the striking piston in succession, shifts the latter alternately in one direction then the other.

In machines of this type, the piston travels to and fro inside a bore or cylinder, in which there is formed, above the piston, a chamber which, delimited in part by this piston, is conventionally known as the top chamber. When this chamber is fed with pressurized fluid, the hydraulic force created therein allows the piston to describe its striking stroke. At the other end of the bore, in which the piston travels, there is formed a second chamber which is also delimited in part by the piston and is conventionally known as the bottom chamber. The force resulting from the fluid pressure in the bottom chamber provides for the travel of the piston for its return stroke.

The overall power of a machine is expressed by the product of the value of the striking frequency and the value of the energy per blow.

It is known that, for a given overall power, it is preferable to favor the energy per blow over the striking frequency, when the tool of the machine encounters hard ground, whereas it is preferable to favour the striking frequency over the energy per blow when the tool encounters soft ground.

The energy per blow is the kinetic energy given to the piston, which depends on the striking stroke and on the feed pressure.

DESCRIPTION OF THE PRIOR ART

To adjust the striking frequency and the energy per blow to suit the hardness of a given piece of ground, two known solutions are described by Patents EP 0,214,064 and EP 0,256,955 in the name of the Applicant Company.

The Patent EP 0,214,064 describes a machine which makes it possible to obtain automatic matching of the percussion parameters, by virtue of the presence, in the cylinder of the machine, of a passage fed with fluid depending on the position of the piston after the impact and possible rebound of the piston on the tool.

The Patent EP 0,256,955 describes a machine which makes it possible to obtain the same result, depending on variants in pressure in the top chamber or the bottom chamber, following the effect of rebound of the piston on the tool, by virtue of the presence of a hydraulic element which is sensitive to these variations.

In both cases, this involves high-performance systems which are well suited to high-power machinery, but which are very expensive and require a high number of circuits, which makes them not very compatible for machines of small and medium power, like those used for perforation or demolition.

SUMMARY OF THE INVENTION

The object of the invention is to provide a method and a machine for its implementation, allowing automatic matching of the frequency and energy per blow of the piston of a percussive machine which is simple reliable and compact, so as to be able in particular to equip machines of small and medium power.

To this end, the invention relates to a method for altering the striking stroke of a percussive machine, moved by a pressurized incompressible fluid, comprising a piston traveling inside a cylinder and delimiting with the latter a top chamber and a bottom chamber which are fed sequentially with high-pressure fluid through action of a distributor connected to a control device making it possible to vary the stroke of the striking piston, and comprising a slide valve mounted in a cylinder, one of the faces of which is acted on by a spring, and the other face of which may be subjected to a fluid pressure, this slide valve comprising a groove connected, on the one hand, to the distributor and, on the other hand, and depending on the axial position of the slide valve, to one of several passages emerging in the cylinder and capable of being placed in communication with the bottom chamber at the end of the upward travel of the striking piston, which consists, during the phase of rebound of the piston following impact, in determining the possible existence of an instantaneous flow rate of fluid flowing out of the top chamber toward the high-pressure fluid feed circuit, this flow rate being determined on the basis of the differential pressure between these two circuits, then, if such a flow rate is detected, in feeding the control device with pressurized fluid to shift the slide valve of the latter in a direction for lengthening the stroke of the striking piston.

This in fact involves acting upon the control device on the basis of the direction and measurement of the instantaneous flow rate flowing from the top chamber at the moment when the position of the distributor corresponds to the phase of rebound of the striking piston. If, in soft soil, the rebound is not very great, the differential pressure resulting from the instantaneous flow rate flowing from the top chamber will not be very great, and the control device will not be actuated, keeping a short stroke for the striking piston. In contrast, if the machine is working in hard ground, the rebound energy will be great, and the drop in pressure head which is created by the instantaneous flow rate of fluid flowing out of the top chamber will be great, creating a differential pressure causing the control device to be fed with pressurized fluid in order to lengthen the stroke of the striking piston.

Advantageously, this method consists possibly in feeding the control device with pressurized fluid only during the phase of rebound of the piston, at the beginning of the movement of the distributor, and while the distributor is still feeding the top chamber with high-pressure fluid.

It is important to gain perfect control over the moment at which the control device must be fed with pressurized fluid, so as to cancel out the hydraulic information resulting from the abrupt stopping of the piston upon its impact under the tool.

According to one feature of the invention, a machine for the implementation of this method includes a control slide valve subjected to the opposing fluid pressures prevailing respectively in the top chamber and in the circuit for feeding the top chamber with high-pressure fluid, this slide valve opening a circuit for feeding the control device with pressurized fluid, when the difference between the pressure in the top chamber and the pressure in the feed circuit exceeds a predetermined value.

Advantageously, the control slide valve is mounted in a cylinder delimiting with the slide valve two opposed chambers connected respectively to the top chamber and to the high-pressure fluid feed passage, and in which there emerge two passages which are connected respectively to a source of pressurized fluid and to the control device, it being possible for these two passages to be placed in communication via a groove that the control slide valve includes, in a certain axial position of this slide valve.

The source of pressurized fluid which feeds the control device through the cylinder of the control slide valve may consist of the high pressure feed circuit itself or of the top chamber. The cylinder of the control slide valve may therefore be connected to one or other of these two sources of pressure.

Advantageously, and in order to gain control over the moment at which the pressurized fluid may be supplied to the control device, taking account of the operating cycle of the machine, the duct for feeding the control device with pressurized fluid passes through a slide valve device, the movement of which is mechanically linked to the movement of the distributor and which comprises a groove which, depending on the position of the slide valve, allows or does not allow pressurized fluid to pass in the direction of the slide valve which selects the stroke of the striking piston, belonging to the control device.

For preference, the groove of the slide valve, which groove is associated with the distributor, is positioned such that it allows pressurized fluid to pass only during the beginning of the stroke of the slide valve of the distributor, at an instant when the distributor is still allowing the top chamber to be fed with high-pressure fluid.

The slide valve associated with the distributor may be either independent of the slide valve of the distributor, or form an integral part thereof.

According to another feature of the invention, this device includes a leakage passage, in permanent or temporary communication with the circuit for feeding the control device with pressurized fluid, which passage is intended to discharge a defined quantity of fluid each cycle in order to return the slide valve of the control device in the direction of reducing the stroke of the striking piston, when this control device is no longer sufficiently fed with pressurized fluid.

BRIEF DESCRIPTION OF THE DRAWINGS

In any case, the invention will be clearly understood with the aid of the description which follows, with reference to the attached schematic drawing representing, by way of nonlimiting examples, several embodiments of this machine.

DESCRIPTION OF THE PREFERRED EMBODIMENTS

Figure 1:
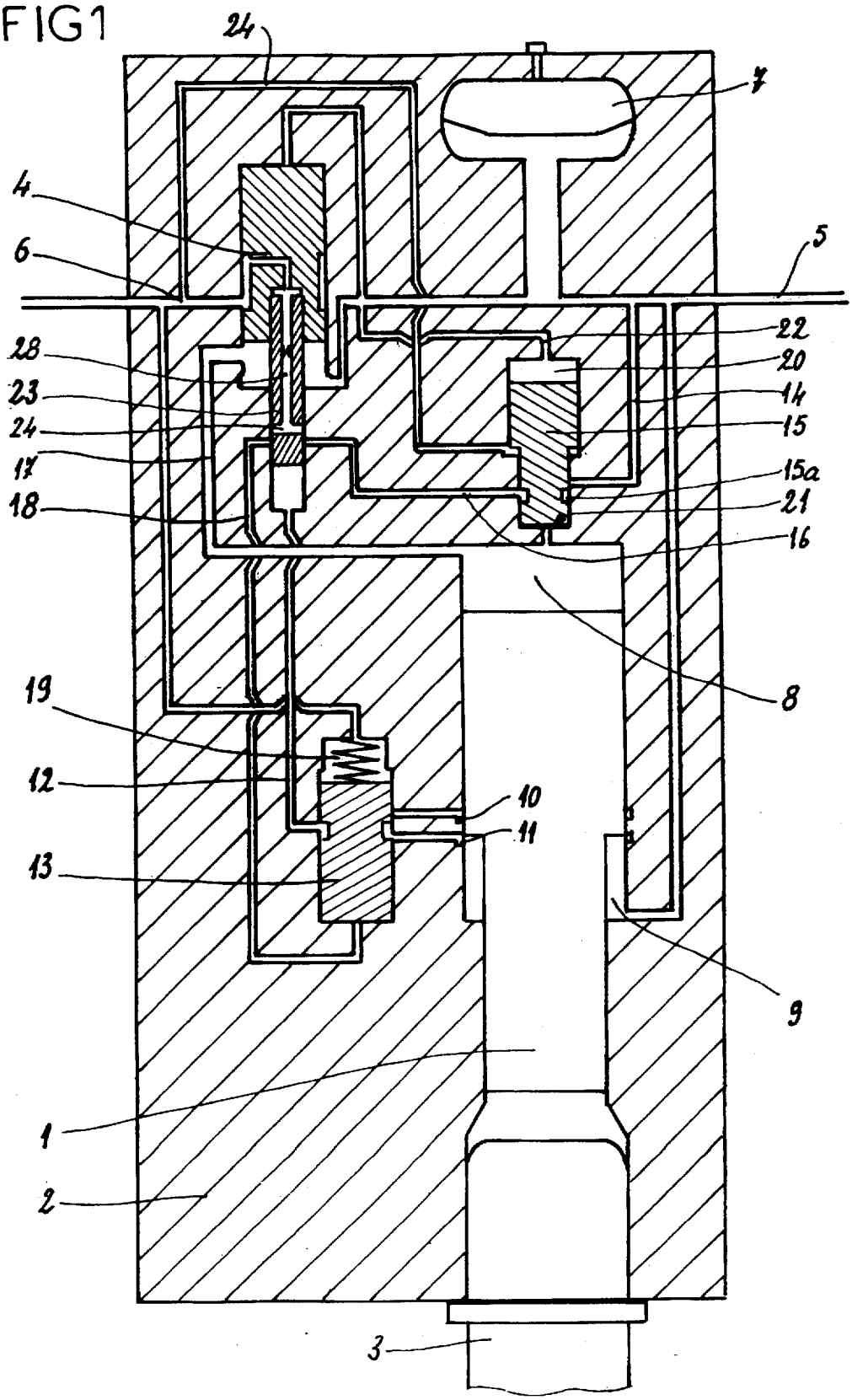
FIG. 1 represents a view in longitudinal section of a first machine.
Figure 2:
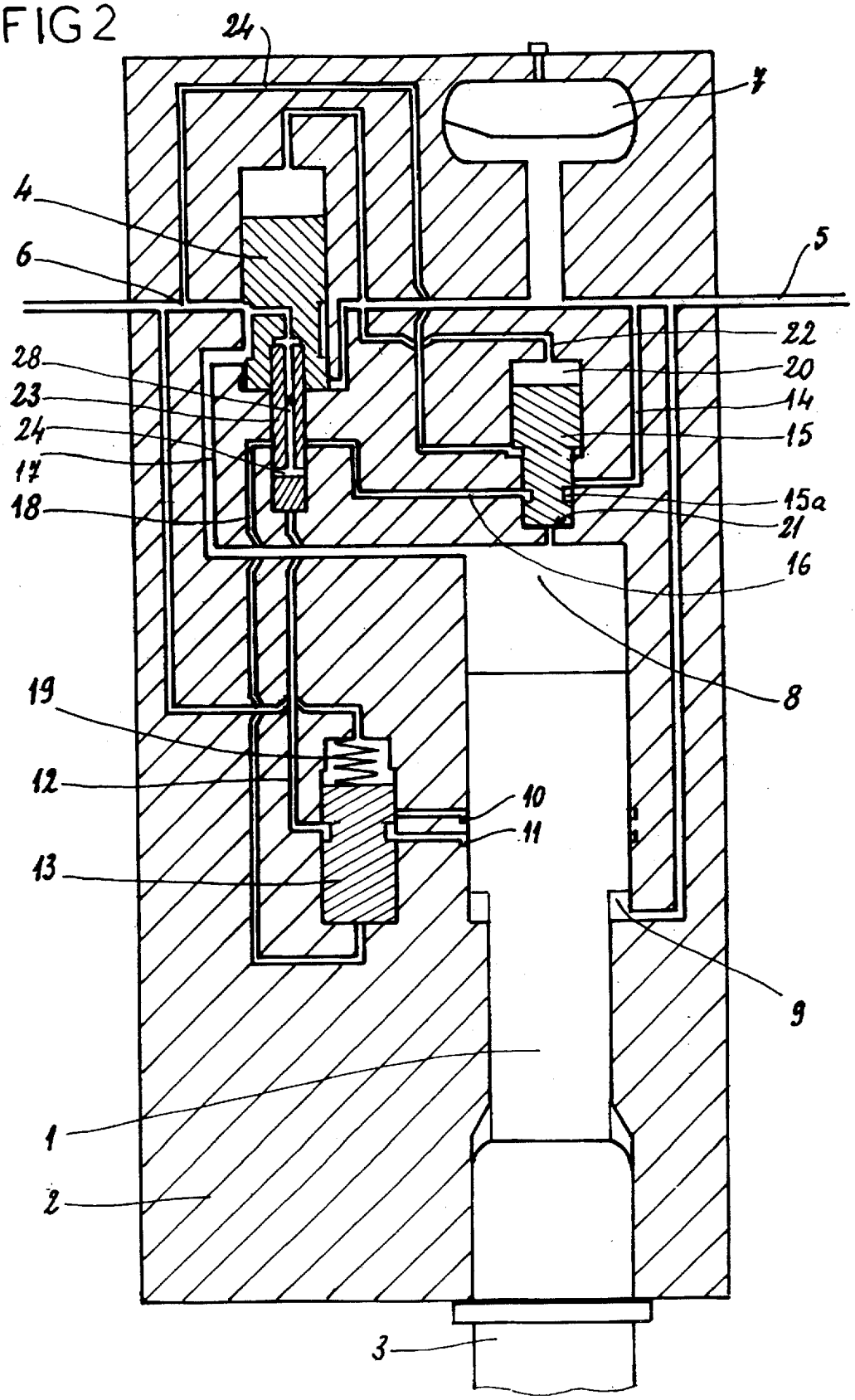
FIG. 2 represents a view in longitudinal section of the same machine in another operating position.

The machine represented in FIG. 1 is a percussive machine comprising a piston 1 sliding in a body 2, and hitting a tool 3 on each cycle. A main distributor mounted in the body 2 comprising a slide valve 4 makes it possible to place the top chamber 8 formed above the piston alternately in communication with the high-pressure fluid feed 5, as shown in FIG. 1, or with the low-pressure circuit 6, as shown in FIG. 2. In addition, the piston 1 forms with the body 2 a lower annular chamber 9, continuously fed via the passage 5, so that each position of the slide valve of the distributor brings about the striking stroke of the piston 1, then the reascent stroke.

The choice of short or long striking stroke is made from a control device which, depending on the position of the stroke selector piston 13, may connect respectively the passages 11 and 12 or the passages 10 and 12. The passage 12 is connected to a control section of the main distributor 4, whereas the passages 10 and 11 emerge in the cylinder containing the piston 1.

In accordance with the invention, the machine includes a slide valve 15 comprising two opposed control chambers: on the one hand the chamber 20 connected via a passage 22 to the high-pressure fluid feed passage 5, and, on the other hand, the chamber 21 connected to the top chamber 8. The machine also includes a second slide valve 23, the movement of which is mechanically linked to the movement of the slide valve 4 of the main distributor and which comprises a groove 24 making it possible to stop the fluid or allow it to pass between a passage 16 originating from the first slide valve 15 and a passage 18 ending in the control chamber of the stroke selector slide valve 13.

The control circuit of the stroke selector 13 comprises a passage 14 connected to the high-pressure fluid duct 5, the slide valve 15, the passage 16, the slide valve 23, and the passage 18 emerging on one section of the stroke selector slide valve 13.

When the ground encountered by the tool is soft, the piston 1 does not rebound on to the tool 3 after the impact, the slide valve 15 is constantly held in the bottom position by the feed pressure originating from the passage 5 and the accumulator 7 via the passage 22 and applied to the largest diameter of the slide valve, whereas the annular section of this slide valve is connected to the low-pressure circuit 6 by a passage 24.

The passage 14, connected to the feed passage 5, does not communicate with the passage 16. The control section of the stroke selector 13 is not fed and this selector, by virtue of the spring 19, remains in the bottom position, placing the control passage 12 of the distributor 4 in communication with the passage 11 corresponding to the short striking stroke of the piston 1.

Figure 3:
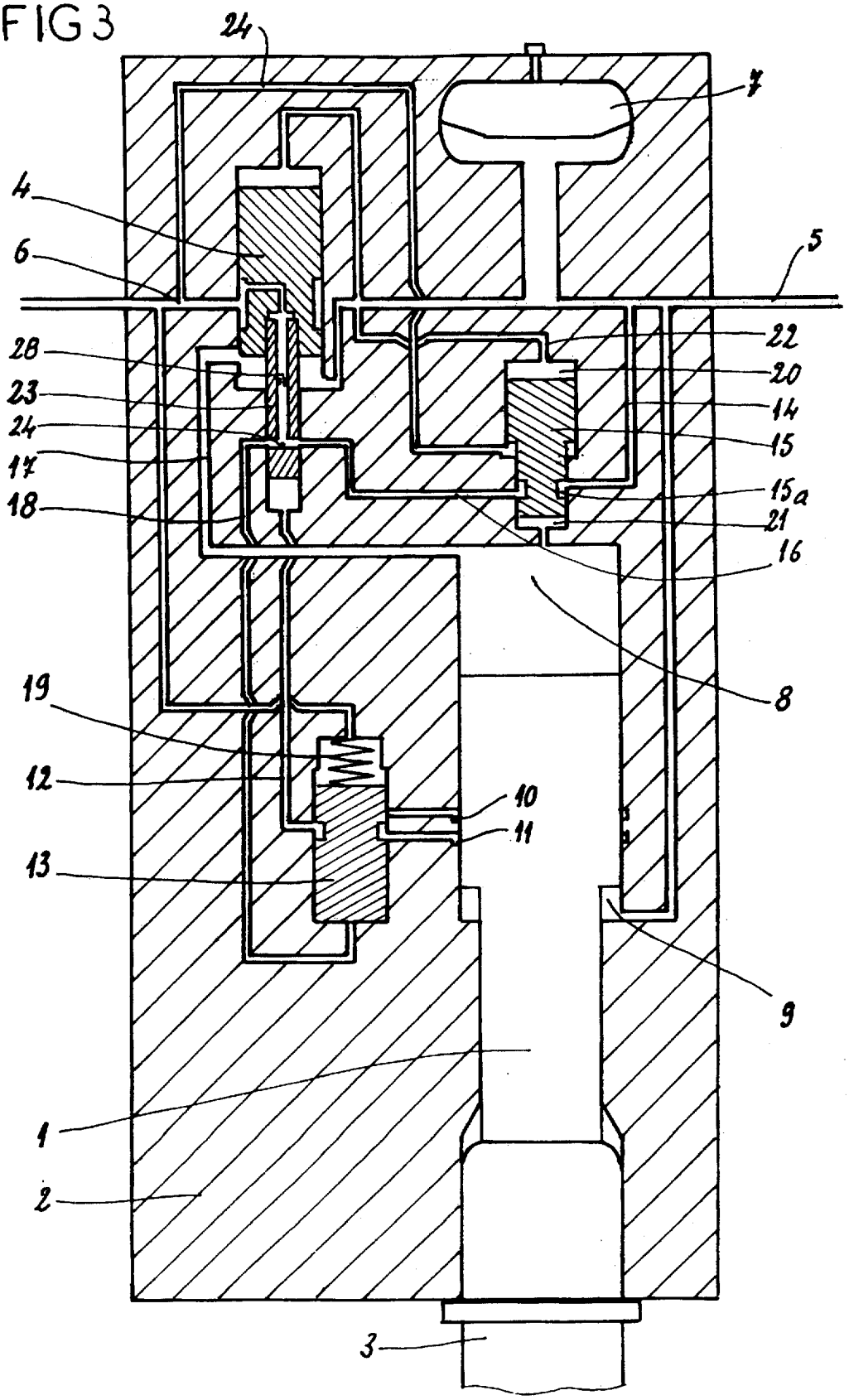
FIG. 3 represents a view in longitudinal section of the same machine in another operating position.

FIG. 3 represents the position of the moving parts when the ground encountered by the tool is hard. The striking piston 1 rebounds just after its impact on the tool 3 and pushes back the fluid in the passage 17, while the main distributor 4 is still in the position of FIG. 1 and is beginning to move from the position of FIG. 1 towards the position of FIG. 2.

The instantaneous flow rate of fluid in the passage 17, at the moment of the rebound of the piston, creates a drop in pressure head and therefore sets up a differential pressure between the top chamber 8 and the opening of the passage 22 into the feed passage 5.

Above and beyond a certain flow rate, this differential pressure is sufficient to raise the slide valve 15. At this moment, the slide valve 15 places the passage 14 and the passage 16 in communication via a groove 15*a*. During this placing in communication, the distributor 4 changes position and the slide valve 23 linked to this distributor briefly connects the passage 16 to the passage 18. The fluid passing in succession from the passage 14 to the passage 16, then to the passage 18, feeds the control section of the stroke selector 13 and allows this selector to be pushed back against the action of the spring 19. This selector 13 then places the control passage 12 of the main distributor 4 in communication with the passage 10 corresponding to the long striking stroke of the piston 1.

The slide valve 15 starts to move only when the instantaneous flow rate goes from the top chamber 8 towards the passage 5, via the passage 17. When the flow rate in the passage 17 is in the direction of filling of the top chamber 8, the slide valve 15 remains immobile.

According to another alternative of the invention, the passage 22 may be connected to the passage 17 instead of the passage 5. In this case the movement of the slide valve 15 is sensitive only to the drop in pressure head due to the instantaneous flow rate leaving the top chamber 8.

FIG. 3 shows the position of the moving parts when, during rebound of the piston, the slide valve 23 whose movement is linked to that of the distributor 4 allows the fluid to pass from the passage 16 towards the passage 18 and the selector 13, at a chosen moment, depending on the relative position of the groove 24 of this slide valve and the opening of the passages 16 and 18. This slide valve 23 includes a central passage 28 emerging in an annular groove making it possible at the same time to connect the passage 16, the passage 18 and, through a calibrated orifice, the low-pressure circuit 6. During operation of the machine, the movements of the striking piston 1 and of the distributor 4 remain constantly linked to one another. Thus, for a specified position of the stroke of the piston 1, the slide valve of the distributor and the slide valve 23 will therefore be in a specified position. By choosing the position of the groove 24 of the slide valve 23 it is possible to predict precisely the space of time in the operating cycle for which the passage of fluid between the passages 16 and 18 will be allowed.

The correct selection is to establish communication between the passages 16 and 18 a few moments after the impact. What happens is that at the moment of the impact of the piston on the tool the slide valve 15 tends to rise under the pressure surge effect due to the abrupt stopping of the striking piston, then immediately descends, if the ground is soft, but remains raised a little longer if the ground is hard. The slide valve 23 makes it possible to eliminate the influence of pressure variations in the top chamber 8, not allowing the fluid to flow out towards the selector 13 until a little later, at the moment when the raising of the slide valve 15 effectively corresponds to the presence of a flow rate set up in the top chamber 8 towards the passage 5, and therefore to a rebound of the piston on hard ground.

When the ground is not sufficiently hard to justify switching to a long stroke of the striking piston, the calibrated orifice contained in the passage 28 discharges, towards the low-pressure circuit 6, all of the fluid originating from the slide valve 15 and from the passage 16. Thus, the passage 18 no longer receives fluid but in contrast discharges through the passage 28 the fluid contained in the control chamber of the slide valve 13, allowing the striking piston to be kept in short stroke mode.

Figure 4:
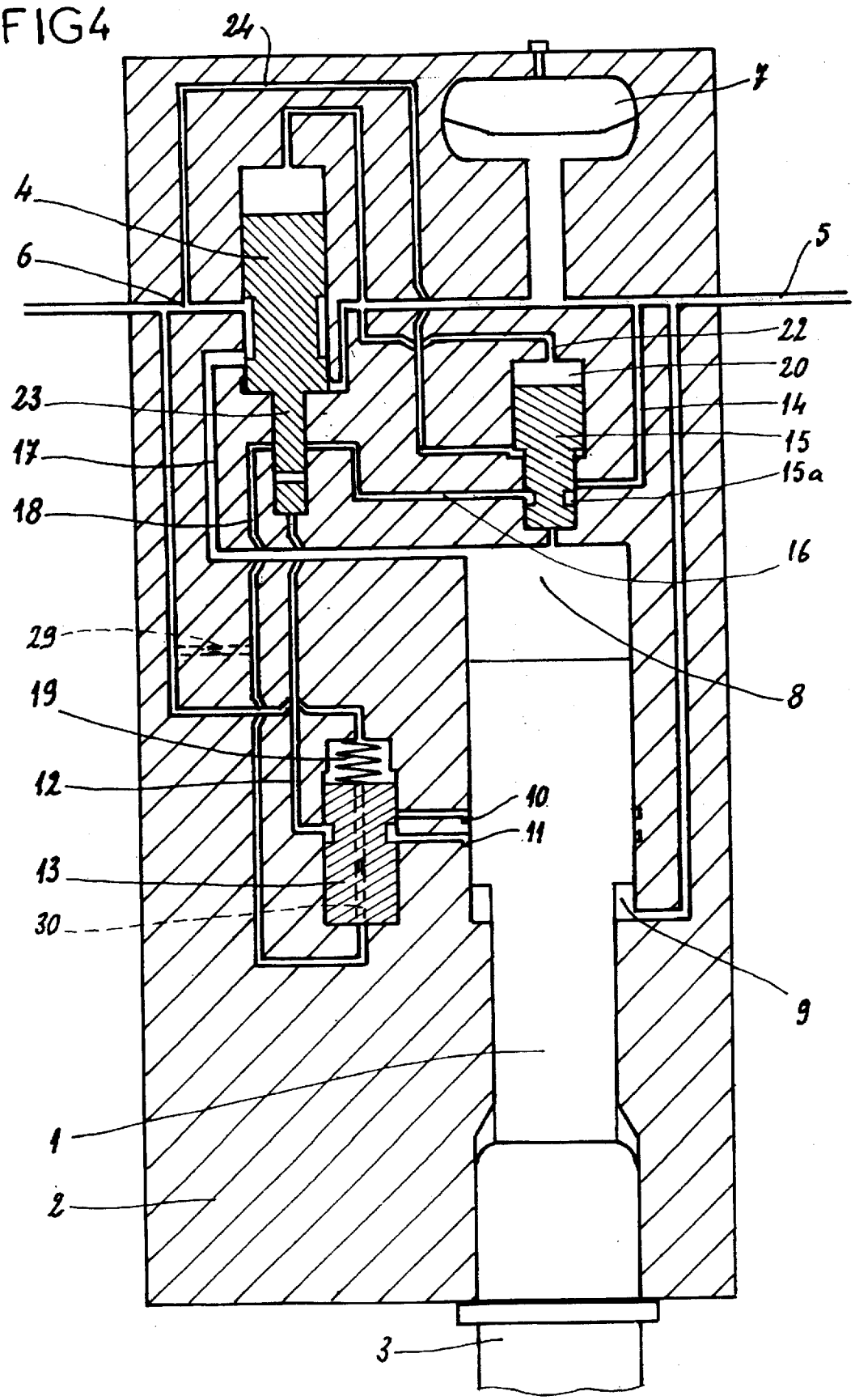
FIG. 4 represents a view in longitudinal section of an alternative of the same machine.

FIG. 4 represents an alternative of the invention, according to which the distributor 4 and the slide valve 23 form just a single piece. In this alternative, the passage 28 is eliminated and replaced with a passage 29 or passage 30 including a calibrated orifice and connecting the passage 18 with the low-pressure circuit 6. In this embodiment, if the quantity of fluid injected via the passage 16 into the control chamber of the slide valve 13 exceeds the quantity of fluid discharged via the passage 29 or 30, then the slide valve 13 is pushed upwards, so as to select the long stroke for the striking piston.

Figure 5:
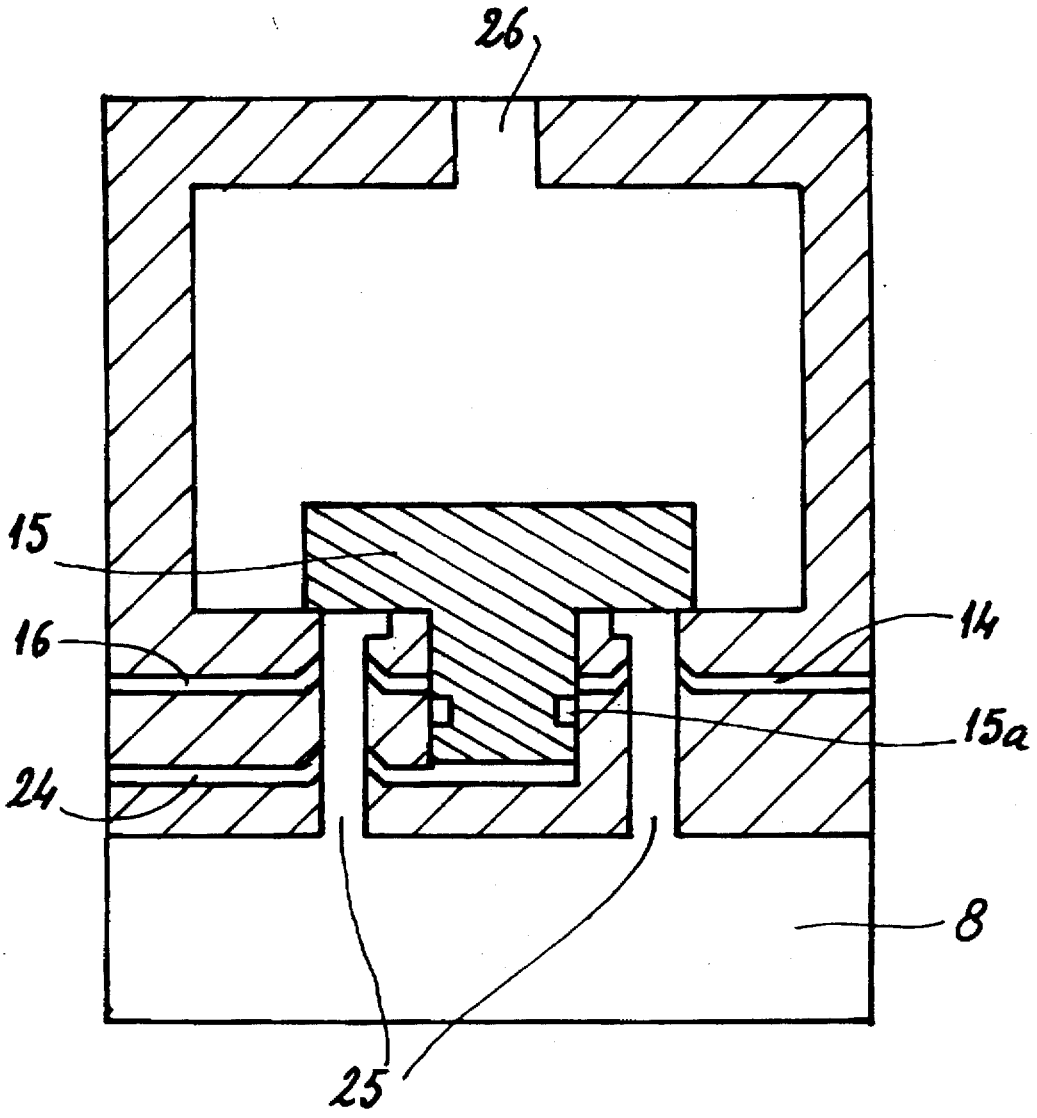
FIG. 5 represents a part view of an alternative of the machine of FIG. 1.

FIG. 5 represents another embodiment of the invention, in which the slide valve 15 consists of a check valve or valve allowing energy recovery. During the phase of rebound of the piston, this check valve, specially arranged according to the invention, comprises a groove **15*a* allowing the passage 14 fed with high pressure to be placed in communication with the passage 16**, at the moment that it lifts.

On hard ground, during its rebound phase, the piston 1 delivers the fluid contained in the top chamber 8 directly through the passage 25, then the passage 26 towards the high pressure circuit 5, lifting the check valve 15. The check valve 15 remains raised as long as the drop in pressure head due to the flow rate between the passages 25 and 26 exceeds the value of the feed pressure multiplied by a constant which depends on the cross sections of the check valve. As the feed pressure is actually kept constant, the check valve 15 therefore remains open above and beyond a given flow rate of discharge from the top chamber 8.

For the entire duration of passage of fluid through this check valve 15, the groove in the check valve places the passage 14 in communication with the passage 16. This makes it possible, through the passage of fluid via the slide valve 23, to feed the passage 18 and therefore control the stroke selector 13 so as to obtain a long striking stroke of the piston for hard ground.

Figure 6:
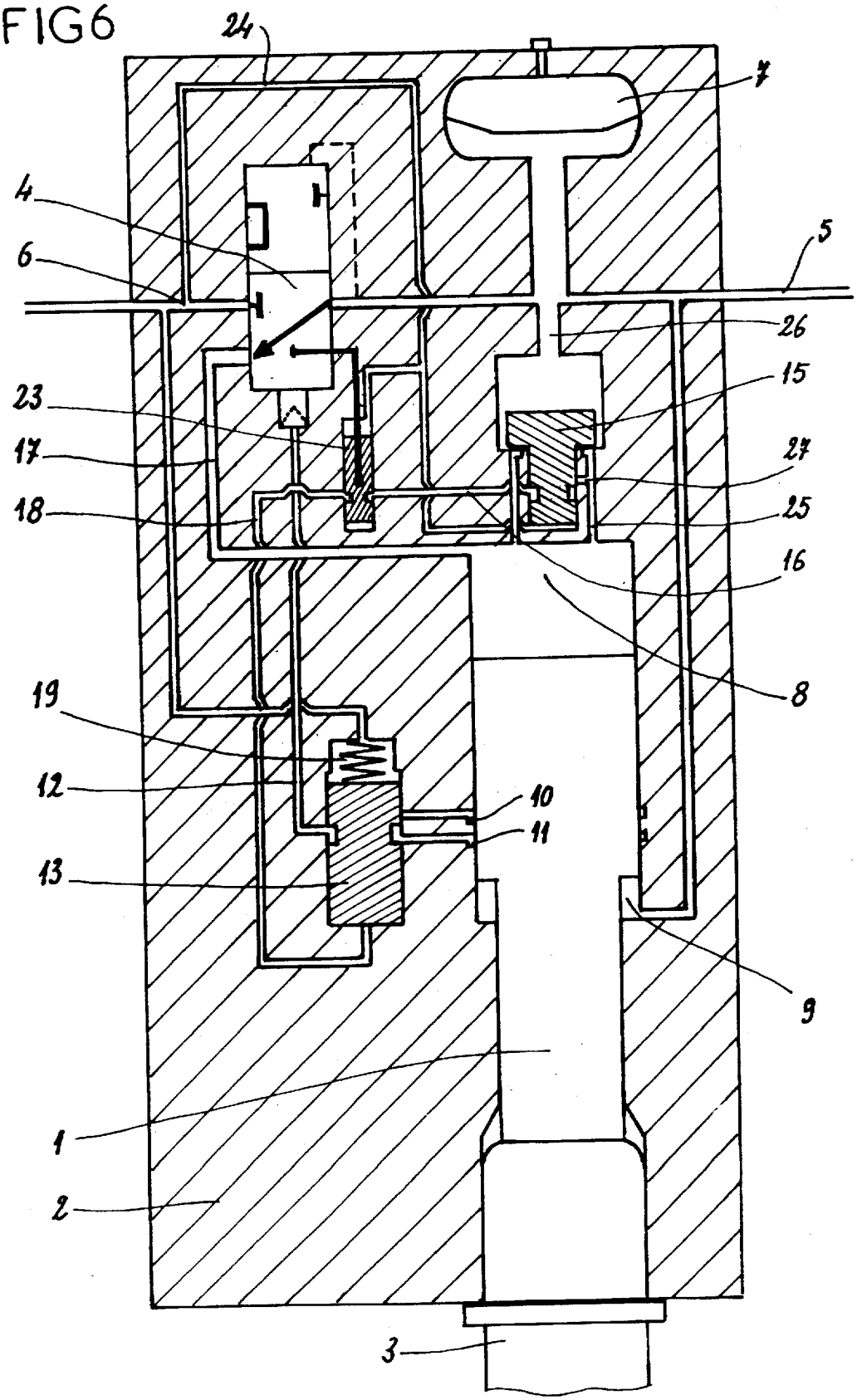
FIG. 6 represents a view in longitudinal section of an alternative of the machine in FIG. 1.

FIG. 6 represents another embodiment of the invention, according to which the passage 14 is replaced by a passage 27 communicating with the top chamber 8. At the moment when the flow rate in the passage 27 is capable of being set up, the top chamber is obviously pressurized. Fluid feed can therefore be taken from the top chamber 8 instead of being taken as before from the inlet passage 5.

As is clear from the foregoing, the invention provides an improvement and simplification to the current state of the art in the field of automatic striking stroke selection for this machinery.

It goes without saying that the invention is not limited merely to the embodiments of this machinery which have been described hereinabove by way of examples, but on the contrary encompasses all alternative embodiments thereof. Thus, in particular, the number of positions of the selector slide valve 13 could be greater than two, without in any way departing from the scope of the invention.

I claim:

1. A device for altering the striking stroke of a percussive machine moved by a pressurized fluid, comprising:

a piston movably located in a cylinder and defining a top chamber and bottom chamber;

a stroke selector piston for varying the stroke of the piston;

a distributor in communication with the top chamber, bottom chamber and the stroke selector piston;

said stroke selector piston located in the cylinder and having a face subjectable to fluid pressure, said stroke selector piston having a groove communicating with the distributor and capable of being placed in communication with the bottom chamber when the piston approaches the top chamber.

2. The device of claim 1, further comprising a first control slide valve which feeds the stroke selector piston with pressurized fluid when a difference between pressure in the top chamber and pressure in a high pressure fluid feed circuit exceeds a predetermined value.

3. The device of claim 2, wherein the first control slide valve is mounted in a second cylinder delimiting with the first control slide valve two opposed chambers connected respectively to the top chamber and to a high-pressure fluid feed circuit, and in which there emerge two passages which are connected respectively to the high pressure fluid feed circuit and to the selector piston, a first control slide valve groove located on the first control slide valve permits fluid communication between the high pressure fluid feed circuit and the selector piston depending on the position of the first control slide valve.

4. The device of claim 3, wherein the second cylinder includes a fluid communication passage that communicates with the high pressure fluid feed circuit.

5. The device of claim 3, wherein the second cylinder includes a fluid communication passage that communicates with the top chamber.

6. The device of claim 3, further comprising a second slide valve mechanically linked to the distributor and comprising a groove which controls communication of pressurized fluid to the stroke selector piston depending on the position of the second slide valve.

7. The device of claim 6, wherein the groove of the second slide valve is positioned such that pressurized fluid can pass only during a beginning of a stroke of the distributor.

8. The device of claim 6, wherein the second slide valve is mechanically linked to and independently movable with respect to the distributor.

9. The device of claim 6, wherein the second slide valve and the distributor form a single piece.

10. The device of claim 1, further comprising a leakage passage that is able to communicate with the pressurized fluid and is constructed to discharge a predetermined quantity of fluid when the stroke selector piston is not sufficiently fed with pressurized fluid, causing the stroke selector piston to move in a direction to reduce the stroke of the piston.

11. A method for altering the striking stroke of a percussive machine moved by a pressurized fluid, comprising:

providing a piston that travels inside a cylinder and delimits, with the cylinder, a top chamber and a bottom chamber;

providing a distributor that sequentially feeds a high-pressure fluid to a stroke selector piston mounted in the cylinder, thus allowing the stroke of the piston to be varied;

providing the stroke selector piston with at least one face subjectable to a fluid pressure and including a return device, said stroke selector piston having a groove that can communicate with the distributor;

connecting the groove, depending on the axial position of the stroke selector piston, to one of a plurality of passages in the cylinder and communicating the groove with the bottom chamber when the piston approaches the top chamber;

determining an instantaneous flow rate of fluid flowing out of the top chamber toward a high pressure fluid feed circuit during rebound of the piston following impact, the flow rate being determined on the basis of a differential pressure between the top chamber and the high pressure fluid feed circuit;

feeding the stroke selector piston with pressurized fluid depending on the detected flow rate.

12. The method of claim 11, further comprising shifting the stroke selector piston in a direction such that the stroke of the piston is lengthened when a flow rate is detected.

13. The method of claim 11, further comprising feeding the stroke selector piston with pressurized fluid only during rebound of the piston, during movement of the distributor, and while the distributor is feeding the top chamber with high-pressure fluid.

* * * * *